United States Patent [19]

Brooks et al.

[11] 4,339,312

[45] Jul. 13, 1982

[54] CONTINUOUS PROCESS FOR THE DIRECT CONVERSION OF POTASSIUM CHLORIDE TO POTASSIUM CHLORATE BY ELECTROLYSIS

[75] Inventors: Wayne E. Brooks, Bryan, Tex.; Jimmie R. Hodges, Downingtown, Pa.; Morris P. Walker, Benton, Ky.

[73] Assignee: Pennwalt Corporation, Philadelphia, Pa.

[21] Appl. No.: 185,972

[22] Filed: Sep. 10, 1980

[51] Int. Cl.[3] ..... C25B 1/14; C25B 1/26

[52] U.S. Cl. ..... 204/95

[58] Field of Search ..... 204/95

[56] References Cited

U.S. PATENT DOCUMENTS

| | | | |
|---|---|---|---|
| 3,329,594 | 7/1967 | Anthony et al. | 204/95 |
| 3,824,172 | 7/1974 | Hodges | 204/269 |
| 3,878,072 | 4/1975 | Cook et al. | 204/95 |
| 3,883,406 | 5/1975 | O'Brien et al. | 204/95 |
| 3,940,323 | 2/1976 | Cook | 204/95 |
| 3,943,042 | 3/1976 | Cook | 204/95 |
| 3,948,748 | 4/1976 | Messner et al. | 204/95 |
| 4,046,653 | 9/1977 | deNora et al. | 204/95 |
| 4,075,077 | 2/1978 | Hodges | 204/269 |

*Primary Examiner*—Howard S. Williams

[57] ABSTRACT

A continuous closed-loop process for directly producing potassium chlorate by electrolysis of an aqueous potassium chloride solution with a metal anode is described. The process provides surprising advantages in efficiency by comparison with conventional double decomposition processes for producing potassium chlorate from electrolyzed sodium chloride.

10 Claims, 3 Drawing Figures

CONTINUOUS PROCESS FOR THE DIRECT CONVERSION OF POTASSIUM CHLORIDE TO POTASSIUM CHLORATE BY ELECTROLYSIS

FIELD OF THE INVENTION

This invention relates to the production of alkali metal chlorates, in particular, potassium chlorate, directly by the electrolysis of an aqueous solution of the corresponding chloride.

BACKGROUND OF THE INVENTION

Historically, commercial quantities of potassium chlorate have been produced by the double decomposition of sodium chlorate and potassium chloride;

$$NaClO_3 + KCl \rightarrow NaCl + KClO_3$$

The sodium chlorate used in this process has ordinarily been produced directly by the electrolysis of an aqueous sodium chloride solution in an electrolytic cell. To each batch of sodium chlorate produced potassium chloride is added stoichiometrically; the resulting $KClO_3$/NaCl solution is cooled; and the $KClO_3$ crystals that form are separated from the solution. The industry practice has been to boil down the remaining solution, or mother liquor, to adjust the water concentration to the level employed in the electrolytic cell and to return the concentrated liquor to the cell for further electrolysis with the NaCl added by the above reaction to produce more sodium chlorate according to the reaction $$NaCl + 3H_2O \rightarrow NaClO_3 + 3H_2\uparrow.$$

Since the separation of $KClO_3$ is not 100% efficient, potassium ions will inevitably be present in the concentrated liquor returned to the cell, necessitating the operation of the cell at high temperatures to prevent the crystallization of the potassium. These high temperatures and the potassium ions present cause very rapid wear results in high equipment costs, while labor costs are elevated by the fact this process is carried out in a batch, rather than on a continuous, basis.

U.S. Pat. No. 3,883,406, the disclosure of which is fully incorporated herein by reference, is directed to a process for recovering electrolytically produced alkali metal chlorates obtained by the direct electrolysis of sodium chloride to sodium chlorate in diaphragmless cells equipped with dimensionally stable anodes of a valve metal, such as titanium, coated with a noble metal and/or oxide thereof. The discussion of the prior art in this patent explains that NaCl is less soluble than $NaClO_3$ at the temperatures conventionally used, so that during the concentration and evaporative cooling steps of the prior art, NaCl crystals separate from the cell liquor first and are removed by filtration or centrifugation. This NaCl may then be redissolved and returned to the cell. U.S. Pat. No. 3,883,406 itself discloses processes wherein solutions are achieved having chlorate concentrations in excess of 700 grams $NaClO_3$ per liter and chloride concentrations as low as 40 grams NaCl per liter. At the high chlorate/chloride concentrations obtained, evaporative cooling causes the chlorate to crystallize first if sufficient vacuum is applied. The particular advantages of the process disclosed in U.S. Pat. No. 3,883,406 are achieved by electrolyzing the NaCl solution to produce a ratio of $NaClO_3$:NaCl of at least 5:1 and preferably at least 7:1.

When the direct electrolysis of alkali metal chlorides to alkali metal chlorates in aqueous solution is carried out, chlorine is produced at the anode while alkali metal hydroxide forms at the cathode. The chlorine and hydroxyl ions are thus free to react chemically to form alkali metal hypochlorite, as is shown by the following equation illustrating the process with potassium:

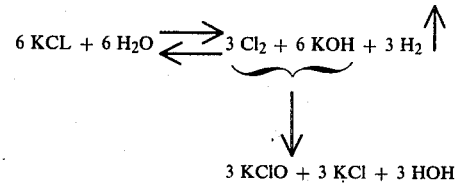

The hypochlorite rapidly converts to form chlorate;

$$3\ KClO \rightarrow 2\ KCl + KClO_3$$

The reversible nature of the formation of alkali metal hypochlorite accounts for significant process inefficiencies where oxygen is liberated into the cell liquor when the hypochlorite decomposes instead of disproportionating into the chloride and the chlorate. Prior to the advent of metal anodes, the direct production of potassium chlorate was uneconomical because the low solubility of $KClO_3$ in water at the temperature previously employed (e.g. 4–5% in $H_2O$ at 30° C.) limited the recovery of $KClO_3$ when compared with the yields available in the conventional double decomposition process.

U.S. Pat. No. 4,046,653 discloses a process for producing sodium or potassium chlorate by the direct electrolysis of the corresponding chloride at temperatures of 90°–110° C. The working example that discloses the electrolysis of potassium chloride starts with a solution containing 300 g per liter of solution as a starting electrolyte, achieving concentrations of 90 g/l potassium chloride and 210 g/l potassium chlorate at steady state operating conditions. While this patent discloses the discharge of an equal volume of electrolyte from the cell as the KCl brine is fed in, we have determined that it is not possible to operate a closed loop process in accordance with this patent using only a saturated brine without adding additional solid KCl directly to the cell electrolyte and that the results stated are not significantly different from those expected from the electrolysis of sodium chloride. In contrast, our process produces surprising results in efficiency increases not accounted for by the heavier weight of potassium chlorate.

SUMMARY OF THE INVENTION

We have invented a continuous closed-loop process for directly producing potassium chlorate by electrolysis of an aqueous potassium chloride solution, providing the first practical metal anode process for producing potassium chlorate by electrolysis and providing surprising advantages in efficiency by comparison with the conventional double decomposition process for producing potassium chlorate from sodium chloride.

This invention provides a continuous closed-loop process for the direct production by electrolysis of potassium chlorate from potassium chloride, wherein an aqueous solution of potassium chloride is electrolyzed in a suitable electrolytic cell having a metal cathode and a metal anode coated with a precious metal or a precious metal oxide. The base of the metal anode may be a metal selected from the group consisting of titanium, zirconium, tantalum and hafnium, with titanium being preferred. The coating may be a precious metal, for example platinum, etc.; an alloy, for example platinum-iridium alloy, etc.; an oxide, for example ruthenium oxide, titanium oxide, etc., including mixtures thereof; or a platinate, for example lithium platinate, calcium platinate, etc. After the solution has been subjected to electrolysis and at least part of the potassium chloride in the solution has been converted to potassium chlorate, the solution is removed as an effluent from the cell and is cooled until crystals of the chlorate form. This cooling may be adiabatic, e.g. under a vacuum, or it may be carried out by refrigeration. After the crystals have formed, they are removed from the effluent by conventional means. The effluent that remains is enriched by adding a controlled amount of potassium chloride to the effluent either as solid potassium chloride or as a concentrated potassium chloride brine. This enriched effluent is then returned to the electrolytic cell as part of the aqueous solution for further electrolysis, at a volume rate equal to the rate at which the unenriched effluent is removed from the cell for cooling crystallization.

In particular, this invention involves a process wherein the effluent removed from the electrolytic cell contains about 8–20% by weight KCl and about 8–20% by weight $KClO_3$, in the ratio of about 0.5–2.5 parts by weight KCl to each part by weight $KClO_3$. In particular, the effluent may contain about 10% $KClO_3$ by weight and less than about 15% KCl by weight. The invention further comprehends electrolytic cell effluents which contain about 10–14% $KClO_3$ and 10–16% by weight KCl. As will be discussed further below, the operation parameters of the process in accordance with this invention are described in FIGS. 2 and 3 of the drawings. The process according to this invention may be particularly carried out within the area HIJK as set forth in FIG. 2.

In addition to the above characteristics and attributes, the process in accordance with our invention may also include a step, interposed in the process at the point after which the effluent is removed from the electrolytic cell and before the effluent is subjected to cooling crystallization, wherein any elemental chlorine present in the effluent is stripped therefrom. In carrying out the process in accordance with this invention, which is exothermic in nature, we have found that the temperature of the electrolytic cell can be controlled when the cell is equipped with coils or, preferably, when the cell liquor is passed through a heat exchanger through which is passed water at a temperature which is above the temperature at which the $KClO_3$ will crystallize from aqueous solutions when it is present in the concentrations selected for use in the process. This may be accomplished in an intermediate step, either before or after crystallizing the $KClO_3$ from the effluent. After operation of the cell over a period of time, the concentrations of KCl and $KClO_3$ in the electrolyte will reach an equilibrium. In the resaturation or enriching step that is part of the invention herein, sufficient solid KCl, or KCl brine, is added to the effluent to restore the KCl concentration in the enriched effluent that is returned to the cell to the level of KCl concentration in the equilibrium solution electrolyzed in the cell.

One of the main features of this invention is the provision for the first time of a practical continuous closed-loop process for the direct conversion of potassium chloride to potassium chlorate, without the attendant inefficiencies of the prior art double decomposition process.

Another important feature of this invention is the provision of a process for producing potassium chlorate that can be practiced in the same apparatus used to convert sodium chloride to sodium chlorate electrolytically, while providing unexpected increases in current efficiency and power consumption.

Yet another feature of the invention is that it provides a process for producing potassium chlorate that may be practiced within a wide range of operating conditions without detriment to the efficiency of the process.

These features and other advantages of this invention will be apparent to persons skilled in this art from reading the specification and the claims appended hereto.

DETAILED DESCRIPTION OF THE INVENTION

Figure 1:
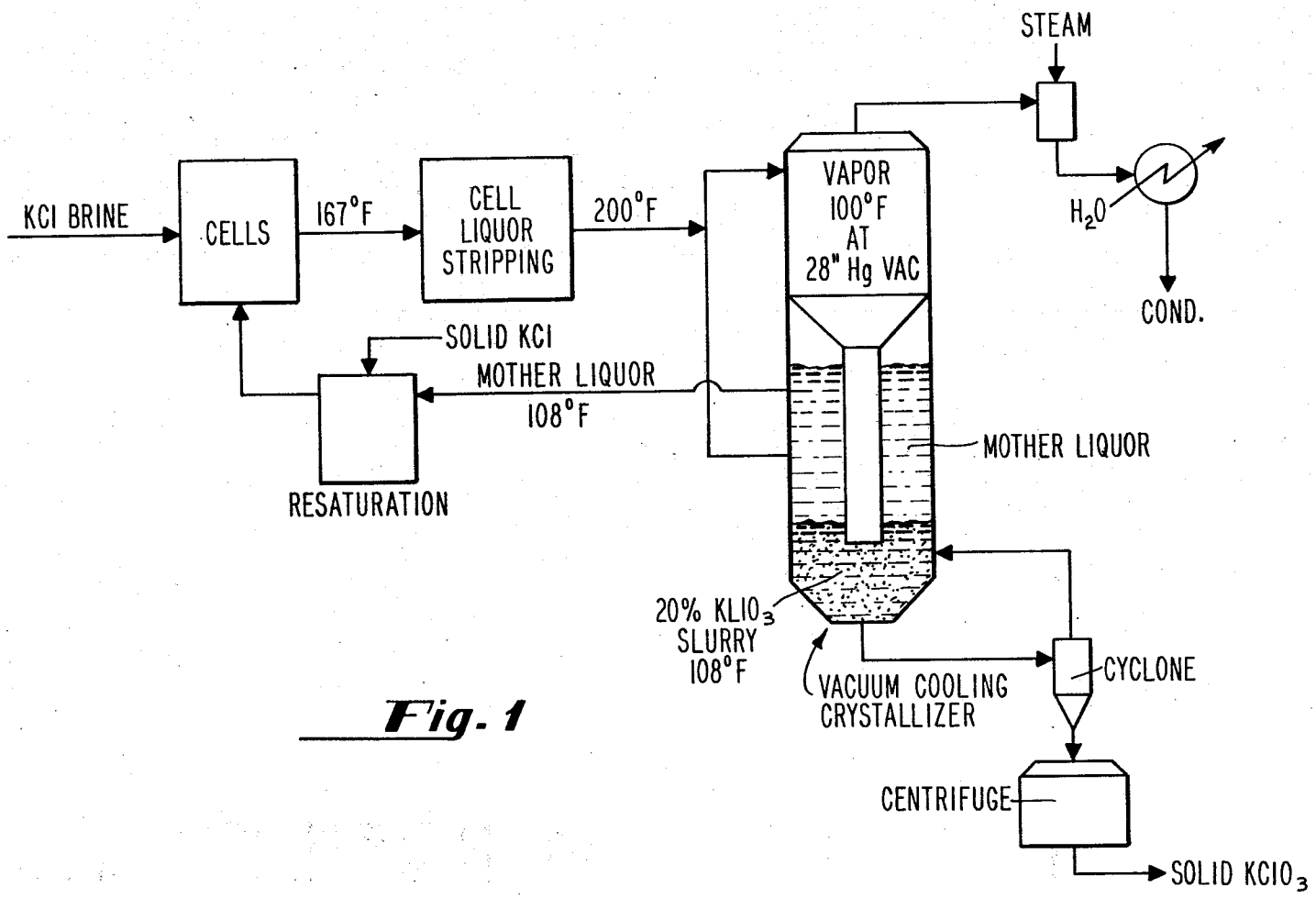
FIG. 1 is a flow diagram depicting the process of this invention.

In this invention potassium chloride is converted by direct electrolysis into potassium chlorate in electrolytic cells using titanium anodes, for example. We employ in our process cells as disclosed in either U.S. Pat. No. 3,824,172 or U.S. Pat. No. 4,075,077, the disclosures of which are hereby incorporated fully by reference. The cells are operated individually or in groups employing series or parallel flow, so that the final cell product contains 8–20% $KClO_3$ and 8–20% KCl. These solutions preferably have a ratio of chloride to chlorate of at least about 0.5:1 and not more than about 2.5:1. FIG. 1 shows the steps of the process by reference to the apparatus components and general process conditions we employ.

When the cell product, or effluent, is removed from the cell or cells, it may optionally be passed through a stripper to remove dissolved elemental chlorine from the effluent before it is cooled. The stripped effluent liquor then passes to a cooling crystallizer, which may be operated either under a vacuum or with refrigeration. Preferably, the effluent is cooled under a high vacuum (28 in. Hg) to a temperature of about 100° F. (38° C.) at which point $KClO_3$ crystals form as a slurry at the bottom of the crystallizer. The $KClO_3$ product is rendered from the slurry by a conventional cyclone and a centrifuge. The mother liquor effluent, now a dilute KCl solution with some residual $KClO_3$ in it, passes through a resaturator, where solid KCl (or KCl brine) is added to restore the concentration of KCl in the liquor to its pre-electrolysis concentration. This enriched liquor is then returned to the electrolytic cell, completing the closed-loop process. Of course, water may also be added to the liquor in the resaturator to control cell concentrations. In carrying out this process persons skilled in this art will adjust the electrolyte pH, use suitable buffering agents, e.g., sodium dichromate, and otherwise optimize process conditions, in light of the disclosures of U.S. Pat. Nos. 3,824,172 and 4,075,077 and conventional practices in this art.

Figure 2:
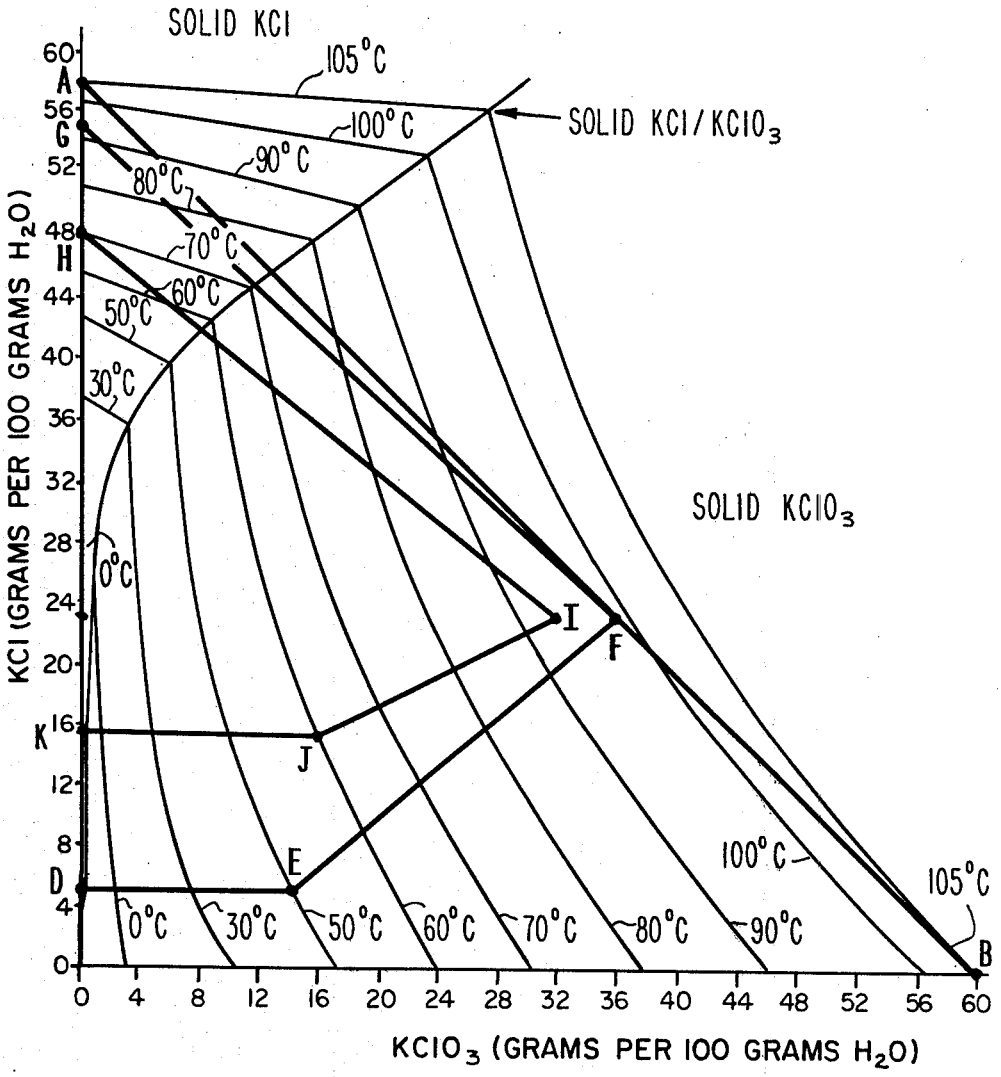
FIG. 2 is an equilibrium phase diagram showing graphically the parameters of the broad scope of this invention.
Figure 3:
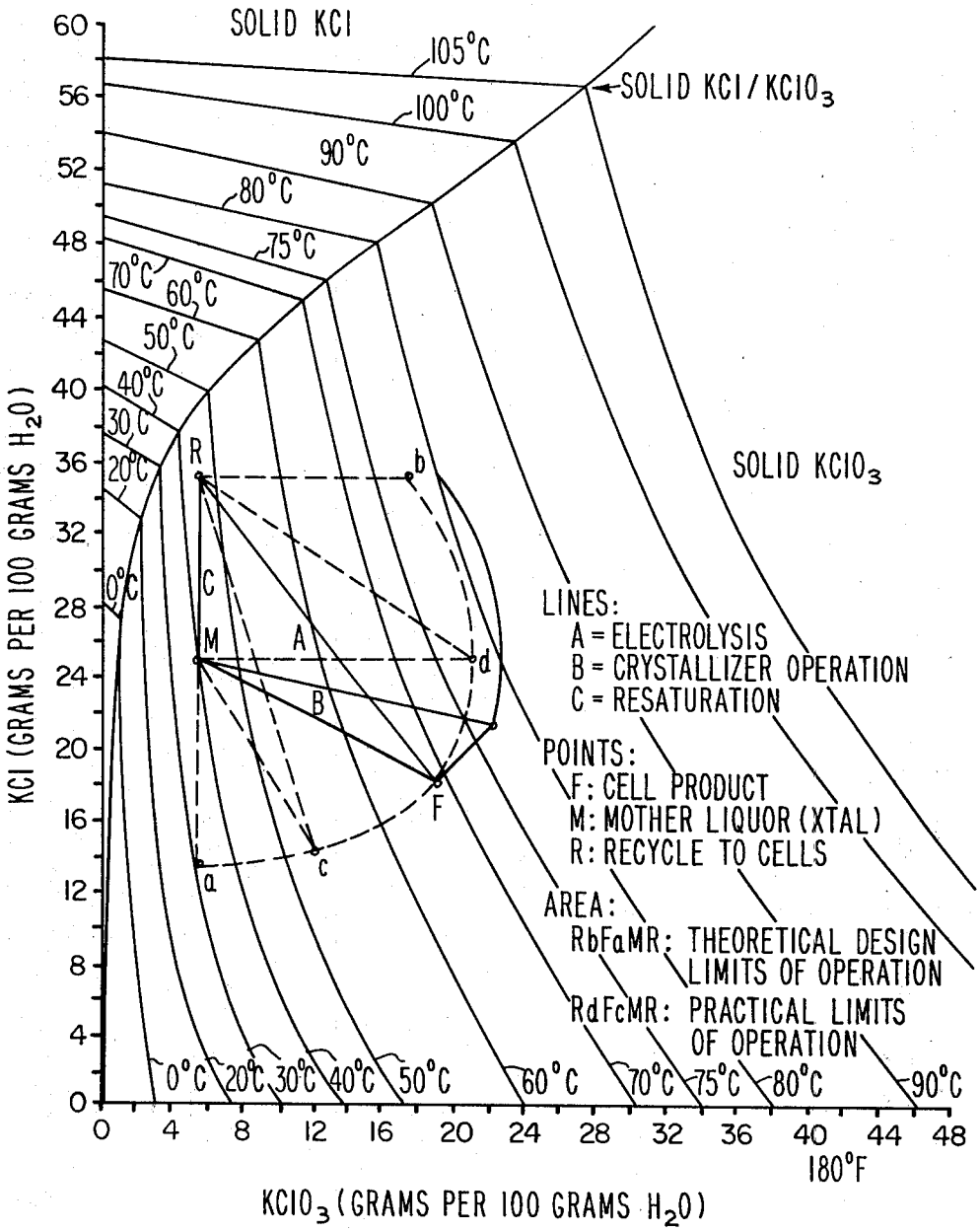
FIG. 3 is an equilibrium phase diagram depicting the more preferred parameters of operation of the process according to this invention.

The equilibrium phase diagrams FIGS. 2 and 3 illustrate the parameters of operation of this process. In FIG. 2, area ABC represents the theoretical range covered by our process. Outside of area ABC it is not possible to perform the steps of electrolysis (line AB) crystallization (line BC) and resaturation with solid KCl and KCl brine (line CA). Realistically the process is most practicable within the area DEFG, while smaller area HIJK represents the desired range of operation for the continuous closed-loop process of this invention.

FIG. 3 depicts the operation within the area HIJK of FIG. 2, with the theoretical and practical limits of a particular process set-up added for emphasis. The area RbFaMR represents the theoretical limits of operation for the particular process design depicted, while area RdFcMR represents the practical limits of that same design. Points R, F and M delimit the process described in the Example below. Line A (connecting points R and F) represents the electrolytic conversion of KCl to $KClO_3$; line B (connecting points F and M) represents the vacuum flash crystallization of $KClO_3$ (at a temperature of about 100° F., as indicated above); and line C (connecting points M and R) represents the resaturation of the effluent liquor with solid KCl, thus closing the material balance. Where crystallization is performed under refrigeration rather than evaporative cooling under a vacuum, the crystallization line B on FIG. 3 will more closely approximate dM than line FM depicted. This, and other, modifications of the process are apparent to persons skilled in this art from an examination of FIGS. 2 and 3.

The following example is a representative illustration of the process according to this invention as demonstrated in FIG. 3:

EXAMPLE

A pilot cell (as disclosed in U.S. Pat. No. 3,824,172) of 5000 amperes capability was operated for 22 days to produce a liquor concentration of 150 g/l $KClO_3$ and 175 g/l KCl (13% $KClO_3$ and 15.3% KCl respectively). The material was passed through a crystallizer tank operated at 100° F. The recycle liquor was returned to a saturator tank where solid KCl was added to achieve the material balance. Solid $KClO_3$ was removed from the crystallizer tank, washed and analyzed. The cell liquor was maintained at 75° C. by a heat exchanger on the circulating liquor. Hot water was used as the cooling media to prevent chlorate crystallization in the exchanger and the cell. The power consumption during this period averaged 3800 KWH (DC) per ton of $KClO_3$ produced.

The particular, and surprising, advantages of the process according to our invention are illustrated by the following Table I:

TABLE I

COMPARISON OF ELECTROLYSIS $KClO_3$ VERSUS $NaClO_3$ pH = 6.5
$Na_2Cr_2O_7$ = 5.0 g/l

| Current Density Amps/in$^2$ | Temperature °F. | Power Usage DC . KWH/Ton | | % Oxygen in Cell Gas | | Cell Voltage | |
|---|---|---|---|---|---|---|---|
| | | $KClO_3$ | $NaClO_3$ | $KClO_3$ | $NaClO_3$ | $KClO_3$ | $NaClO_3$ |
| 1.5 | 167 | 3,642 | 4,532 | 1.022 | 2.98 | 3.082 | 3.378 |
| 2.0 | 167 | 3,781 | 4,925 | 1.418 | 2.98 | 3.191 | 3.797 |
| 2.5 | 167 | 3,920 | 5,318 | 1.022 | 2.98 | 3.300 | 4.080 |

% Overall Current Efficiency:
$KClO_3$ = 100.50
$NaClO_3$ = 88.03

Ordinarily, whether a process is closed-loop or continuous is not of great importance, where the batch process is easily and cheaply carried out. However, when the findings of Table I are considered, it is apparent that the direct production of $KClO_3$ from KCl is unexpectedly more efficient than the production of $NaClO_3$ (and thus $KClO_3$ by the double decomposition method) from NaCl under analogous process conditions. Our process may be carried out with the same equipment as the process disclosed in U.S. Pat. No. 3,883,406, but with results that provide efficiencies, based on electric power usage, of $KClO_3$ production hitherto unavailable. Table I shows that under the same conditions of temperature and current density, the electrolysis of KCl to $KClO_3$ in accordance with our process is 12% more efficient, consumes 25% less power per ton of product and produces significantly less oxygen in the cell gas, as compared with the electrolysis of NaCl to $NaClO_3$.

We have learned, subsequent to our making of this invention, that the efficiency of our process is further enhanced by ensuring that the apparatus in which the process is carried out is constructed so that all portions of the system which come into contact with the effluent are substantially devoid of nickel and other transition elements, in particular copper, manganese, zinc and cobalt. It has been determined that the oxygen content of the cell gas, which negatively correlates with the efficiency of conversion of chloride to chlorate (the oxygen being liberated by the undesired decomposition of the hypochlorite intermediate), is significantly reduced from usual levels when the nickel and other transition metals loadings in the cell liquor are kept below 1 ppm.

Another refinement is the control of the water temperature, in the exchanger at a temperature which is above the temperature in which $KClO_3$ will crystallize from aqueous solution when present in a particular concentration chosen for operation of the process. The electrolytic conversion of potassium chloride to potassium chlorate is known to be exothermic, but in the past, workers in this art have preferred to rely upon the rapid movement of the electrolyte itself through the cell to provide cooling. We have found that the process yields may be increased by permitting additional residence time in the cell, if the liquor is cooled, not with cold water, but with water that has a temperature which is selected to be below the equilibrium temperature of the cell, which is ordinarily about 167° F. (75° C.), but above the temperature at which $KClO_3$ will crystallize from the solution along the walls of the cell. This method also has the advantage of reducing power consumption for cooling over either refrigerative cooling or providing cooling by rapid transport of electrolyte through the cell.

The foregoing description of our invention has been directed to particular embodiments in accordance with the requirements of the Patent Act and for purposes of explanation and illustration. It will be apparent, however, to those skilled in the art that many modifications and changes in both apparatus and procedure may be made without departing from the scope and spirit of the invention. For example, it is apparent that persons skilled in the art may modify the particular apparatus set up disclosed in order to satisfy the needs of any particular field installation or to use equipment of equivalent function to the equipment disclosed. It is further apparent that persons of ordinary skill in this art will, on the basis of this disclosure, be able to practice the invention within a broad range of process conditions. These, and other, modifications of the process according to this invention will be apparent to those skilled in the art. It is our intention in the following claims to cover all such equivalent modifications and variations as fall within the true scope and spirit of the invention.

What is claimed is:

1. A continuous closed-loop process for the direct production by electrolysis of potassium chlorate from potassium chloride, comprising the steps of:

(a) electrolyzing an aqueous solution of potassium chloride in an electrolytic cell having a metal cathode and a coated metal anode, said coating comprising a precious metal, a precious metal alloy, a precious metal oxide or a platinate, (b) passing said aqueous solution through a heat exchanger using a heated cooling medium which is at a temperature which is below the equilibrium temperature of said aqueous solution in said cell but above the temperature at which potassium chlorate crystallizes from solutions of the concentration selected for the process;

(c) removing from said cell an effluent solution containing potassium chlorate formed by said electrolysis of potassium chloride;

(d) cooling said effluent until crystals of the chlorate form;

(e) removing said chlorate crystals from said effluent;

(f) enriching said effluent by adding a controlled amount of potassium chloride thereto; and (g) returning and adding the enriched effluent to said electrolytic cell for further electrolysis, at a volume rate equal to the rate at which the unenriched effluent is removed from the cell in step (c).

2. The process of claim 1, wherein the effluent contains about 8–20% by weight KCl and about 8–20% by weight $KClO_3$, in the ratio of about 0.5–2.5 parts by weight KCl to each part by weight $KClO_3$, and wherein the process is carried out within the area DEFG set forth in FIG. 2.

3. The process of claim 1, wherein the effluent contains about 8–20% by weight KCl and about 8–20% by weight $KClO_3$, in the ratio of about 0.5–2.5 parts by weight KCl to each part by weight $KClO_3$, and wherein the process is carried out within the area HIJK set forth in FIG. 2.

4. The process of claim 3, wherein the effluent contains about 10% $KClO_3$ by weight and less than about 15% KCl by weight.

5. The process of claim 3, wherein the effluent contains about 10–14% by weight $KClO_3$ and about 10–16% by weight KCl.

6. The process of claim 3, 4 or 5, further including stripping any elemental chlorine present in said effluent obtained from step (b) before carrying out step (c).

7. The process of claim 3, 4 or 5, wherein the effluent is subjected in step (b) to evaporative cooling.

8. The process of claim 3, 4 or 5, wherein enriching step (d) comprises adding sufficient solid KCl to the effluent to restore the KCl concentration in the enriched effluent returned to the cell to the level of KCl concentration in the aqueous solution of step (a).

9. The process of claim 3, 4 or 5, wherein the anode comprises a base of a metal selected from the group consisting of titanium, zirconium, tantalum and hafnium, coated with a material selected from the group consisting of platinum, platinum-iridium alloys and ruthenium oxide.

10. The process of claim 1 wherein the cooling medium is hot water.

* * * * *